US007168378B2

(12) United States Patent
Fukao

(10) Patent No.: US 7,168,378 B2
(45) Date of Patent: Jan. 30, 2007

(54) EMBROIDERY FRAME

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/285,188

(22) Filed: Nov. 23, 2005

(65) Prior Publication Data

US 2006/0107881 A1 May 25, 2006

(30) Foreign Application Priority Data

Nov. 24, 2004 (JP) ..... 2004-339344

(51) Int. Cl.
*D05C 9/04* (2006.01)
*D05B 39/00* (2006.01)

(52) U.S. Cl. ..... 112/103; 38/102.2

(58) Field of Classification Search ..... 38/102, 38/102.1, 102.2, 102.91; 112/103; 160/371, 160/378, 380
See application file for complete search history.

(56) References Cited

U.S. PATENT DOCUMENTS 623,301 A * 4/1899 Allen ..... 38/102.2
2,760,299 A * 8/1956 Gable et al. ..... 38/102.2
4,079,529 A * 3/1978 Jennen et al. ..... 38/102.2
4,411,208 A * 10/1983 Nishida et al. ..... 112/103
4,485,574 A * 12/1984 Bennetot ..... 38/102.2
4,723,367 A * 2/1988 Samoilov et al. ..... 38/102.2
5,237,941 A * 8/1993 Kraft et al. ..... 112/103
5,915,315 A * 6/1999 Bentz ..... 112/103
6,901,870 B2 * 6/2005 Eklof et al. ..... 112/103
6,968,792 B2 * 11/2005 Hori ..... 112/103

FOREIGN PATENT DOCUMENTS

JP U-7-15793 3/1995

* cited by examiner

*Primary Examiner*—Ismael Izaguirre
(74) *Attorney, Agent, or Firm*—Oliff & Berridge, PLC

(57) ABSTRACT

An embroidery frame is disclosed which is detachably attached to an embroidery unit and provided with outer and inner frames that clamp therebetween an embroidery cloth extending across an underside of the inner frame. The embroidery frame includes a first inclined surface which is provided at least on a part of a cloth-clamping surface of the outer frame that holds the cloth between the inner and outer frames, and which is upwardly inclined toward an inside of the outer frame. The embroidery frame further includes a second inclined surface which is provided in a portion of the cloth-clamping surface of the inner frame corresponding to the first inclined surface, the inner frame holding the cloth between the outer and inner frames, and which is upwardly inclined toward an inside of the inner frame.

14 Claims, 8 Drawing Sheets

EMBROIDERY FRAME

CROSS-REFERENCE TO RELATED APPLICATIONS

This application is based upon and claims the benefit of priority from the prior Japanese Patent Application No. 2004-339344, filed on Nov. 24, 2004 the entire contents of which are incorporated herein by reference.

BACKGROUND

The present disclosure relates to an embroidery frame that holds a workpiece cloth to be sewn between an outer frame and an inner frame.

TECHNICAL FIELD

Conventional embroidery frames have generally been constructed by an outer frame and an inner frame. Tension is applied to workpiece cloth placed on the outer frame by pressing the inner frame into the outer frame. A fastening screw is provided on the outer frame, and the fastening screw is tightened so that the workpiece cloth is clamped between the outer and inner frames.

The embroidery frame having the above construction is disclosed, for example, in JP-U-7-15793. The outer frame of the embroidery frame is provided with a scale corresponding to a thickness of the workpiece cloth. An end of the fastening screw is aligned with the applicable scale in tightening the fastening screw.

The embroidery frame is attached to an embroidery frame driving mechanism of a sewing machine, which is capable of embroidery sewing with the workpiece cloth clamped between the outer and inner frames. By moving the embroidery frame independently in two mutually perpendicular directions by the embroidery frame driving mechanism, embroidery is formed on the workpiece cloth.

The above-described embroidery frame includes embroidery frames in an oblong form having a pair of circular-arc ends which are connected by a pair of substantially straight portions or substantially rectangular forms having a pair of long sides and a pair of short sides. For example, FIG. 12 is a longitudinal side section of a substantially rectangular embroidery frame 100. As shown in FIG. 12, the embroidery frame 100 is constructed by an inner frame 101 and an outer frame 102 that clamp a workpiece cloth 103 therebetween. A cloth-clamping surface 101*a* of the inner frame 101 and a cloth-clamping surface 102*a* of the outer frame 102 are arranged so as to be perpendicular to the upper or the lower surface of the inner frame and the outer frame respectively.

However, in the embroidery frame 100 having the above described construction, there are cases where long sides 101*b* of the inner frame 101 are deformed so as to be bent in the upward direction by the tension of the workpiece cloth 103. When the long sides 101*b* of the inner frame 101 are thus deformed so as to be bent upwards, the workpiece cloth 103 cannot securely be clamped by the inner and outer frames 101 and 102, and the embroidery area of the workpiece cloth 103 cannot be retained in a flat state. Hence, embroidery sewing performed under such a condition results in a shrinking of the workpiece cloth, thereby deforming the embroidery pattern and reducing the sewing quality.

Furthermore, in the above embroidery frame 100, as shown in FIG. 13, when a fastening screw 104 is loosened and the outer frame 102 is spread, the shape of the inner periphery of the outer frame 102 and the shape of the outer periphery of the inner frame 101 are not similar. Therefore, it is difficult to accurately determine the location in which the inner frame 101 is to be fitted with the outer frame 102, which is located below the workpiece cloth 103; and in some cases, the workpiece cloth 103 is clamped with the inner frame 101 misplaced with respect to the outer frame 102. In such a case, since the workpiece cloth 103 is not evenly held between the cloth-clamping surfaces 101*a* and 102*a* of the inner and outer frames 101 and 102, embroidery sewing performed under such a condition again results in the shrinking of the workpiece cloth, consequently deforming the embroidery pattern and impairing the sewing quality.

The above described problem occurs also in substantially elliptic embroidery frames or in oval-form embroidery frames.

SUMMARY

Therefore the object of the present disclosure is to provide an embroidery frame that prevents the upward-bending deformation which is caused by the tension of the workpiece cloth.

An embroidery frame of the present disclosure is detachably attached to an embroidery unit and is provided with an outer frame and an inner frame that clamp embroidery cloth. The embroidery frame comprises a first inclined surface which is provided at least on a part of a cloth-clamping surface of the outer frame that holds the cloth between the inner and outer frames, and which is upwardly inclined toward an inside of the outer frame; and a second inclined surface which is provided in a portion of the cloth-clamping surface of the inner frame corresponding to the first inclined surface, the inner frame holding the cloth between the outer and inner frames, and which is upwardly inclined toward an inside of the inner frame.

According to the above-described construction, when the cloth to be embroidered is clamped between the outer and inner frames, the first inclined surface of the outer frame contacts the second inclined surface of the inner frame from the obliquely upward direction. Therefore, even if a force to transform the inner frame in the upward direction is operated on the inner frame by the cloth tension, the outer frame does not allow the upward transformation of the inner frame, and the cloth can be securely clamped between the outer frame and the inner frame. Also, since the embroidery area portion of the cloth can be retained as a flat surface, the quality of the embroidery pattern formed on the embroidery area portion can be improved.

In this case, when the outer and inner frames are each formed in a substantially elliptic or oval form that has a circular-arc portion and a substantially straight portion, the first and second inclined surfaces are desirably provided on the cloth-clamping surface of the substantially straight portion of the outer frame and the cloth-clamping surface of the substantially straight portion of the inner frame respectively.

Also, in case the outer and inner frames are each formed in a substantially rectangular form having a long side and a short side, the first and second inclined surfaces are desirably provided on the cloth-clamping surfaces of the long sides of the outer and inner frames respectively.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE INVENTION

Figure 1:
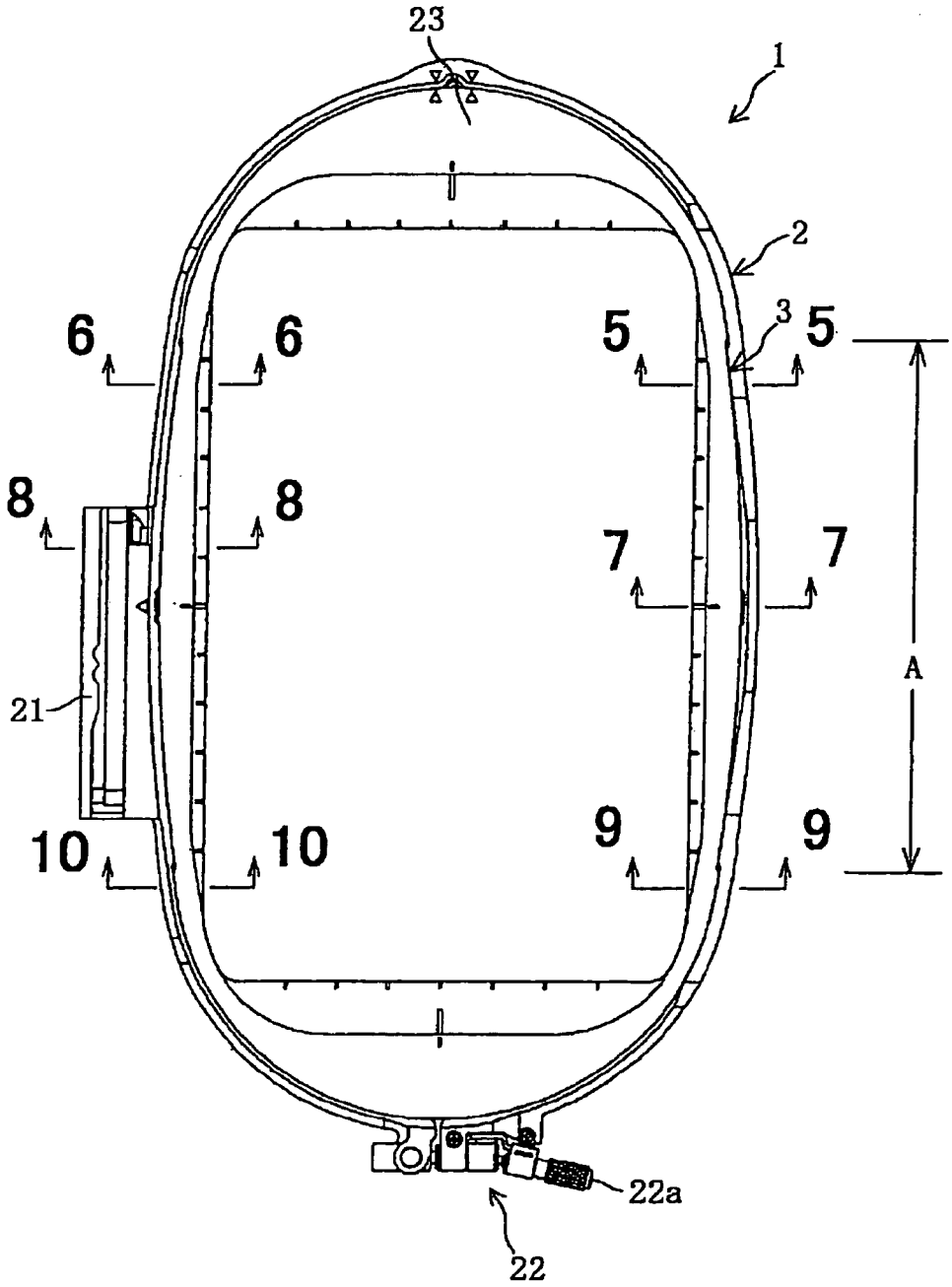
FIG. 1 shows a plan view of an embroidery frame according to a first illustrative aspect of the present disclosure.

A first embodiment of the present invention will be described with reference to FIGS. 1 to 10. In the embodiment, the invention is applied to an embroidery frame attached to an embroidery unit of a sewing machine capable of embroidery sewing. Referring to FIG. 1, an embroidery frame 1 according to the present invention is formed in an elongated substantially elliptic form or an oval form; and is constructed by an outer frame 2 and an inner frame 3, which is attached to the inner side of the outer frame 2 so as to clamp the workpiece cloth. Therefore, an inner peripheral surface of the outer frame 2 is defined as a cloth-clamping surface 2*a* and an outer peripheral surface of the inner frame 3 is defined as a cloth-clamping surface 3*a*.

Figure 2:
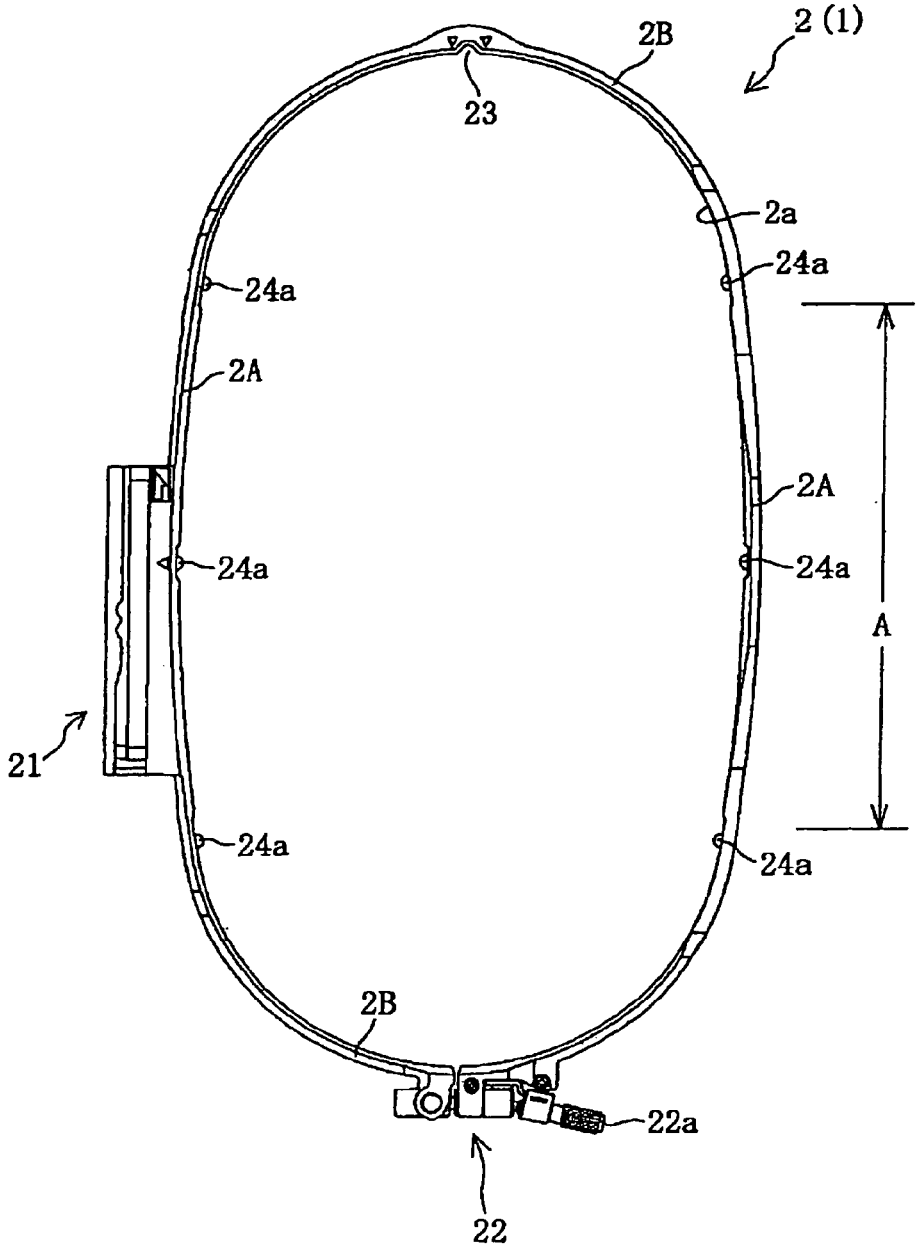
FIG. 2 shows a plan view of an outer frame.

The outer frame 2 is formed by a synthetic resin, and as shown in FIG. 2, is constructed in an elongate substantially elliptic form having a pair of substantially straight portions 2A and a pair of circular-arc portions 2B. In FIG. 2, symbol A indicates a range of each substantially straight portion 2A.

The outer frame 2 is provided with a link portion 21, a fastening screw mechanism 22, an engagement recess 23 functioning as a locating portions and a plurality of inner frame receiving portions 24*a* formed in a tongue-like form. The link portion 21 is detachably linked to a carriage of an embroidery frame driving mechanism of the embroidery unit.

The fastening screw mechanism 22 increases and decreases the width of a splitting portion located near the center of one of the circular-arc portions 2B of the outer frame 2, and is provided with an operator 22*a*. Before attaching the inner frame 3 to the outer frame 2, the width of the splitting portion of the outer frame 2 is to be increased by rotating the operator 22*a*. Then, after arranging the workpiece cloth 4 in a tensed state by pressing the inner frame 3 into the outer frame 2 along with a workpiece cloth 4, the operator 22*a* is rotated, and the width of the splitting portion of the outer frame 2 is narrowed. Thus, the workpiece cloth 4 is firmly clamped between the outer and inner frames 2 and 3.

An engagement recess 23 is formed on the inner surface (cloth-clamping surface 2*a*) in the center of the other circular-arc portion 2B of the outer frame 2. The engagement recess 23 is provided for locating the inner frame 3 with respect to the outer frame 2 in the predetermined location.

Figure 7:
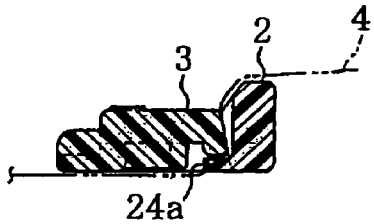
FIG. 7 shows an enlarged sectional view taken along line 7—7 of FIG. 1.
Figure 8:
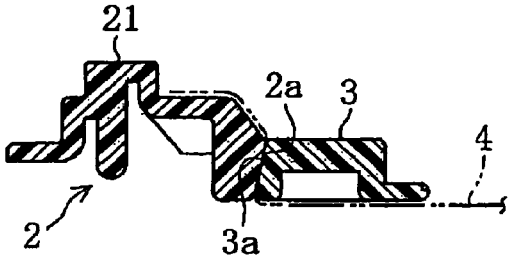
FIG. 8 shows an enlarged sectional view taken along line 8—8 of FIG. 1.
Figure 9:
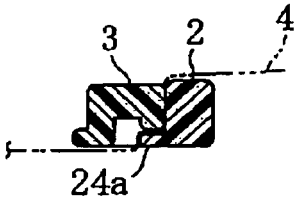
FIG. 9 shows an enlarged sectional view taken along line 9—9 of FIG. 1.
Figure 10:
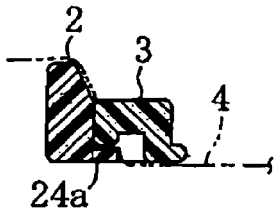
FIG. 10 shows an enlarged sectional view taken along line 10—10 of FIG. 1.

The inner frame receiving portions 24*a* are provided on the inner periphery of the outer frame 2; specifically near the center of the substantially straight portions 2A and in the lower portion near the border of the substantially straight portions 2A and the circular-arc portions 2B (refer to FIGS. 7, 9 and 10). When the inner frame 3 is attached to the outer frame 2, the inner frame receiving portions 24*a* contact a lower end of the inner frame 3 from the underside and receive the inner frame 3. Thus, the inner frame 3 is attached to the outer frame 2 in a predetermined vertical location.

Figure 3:
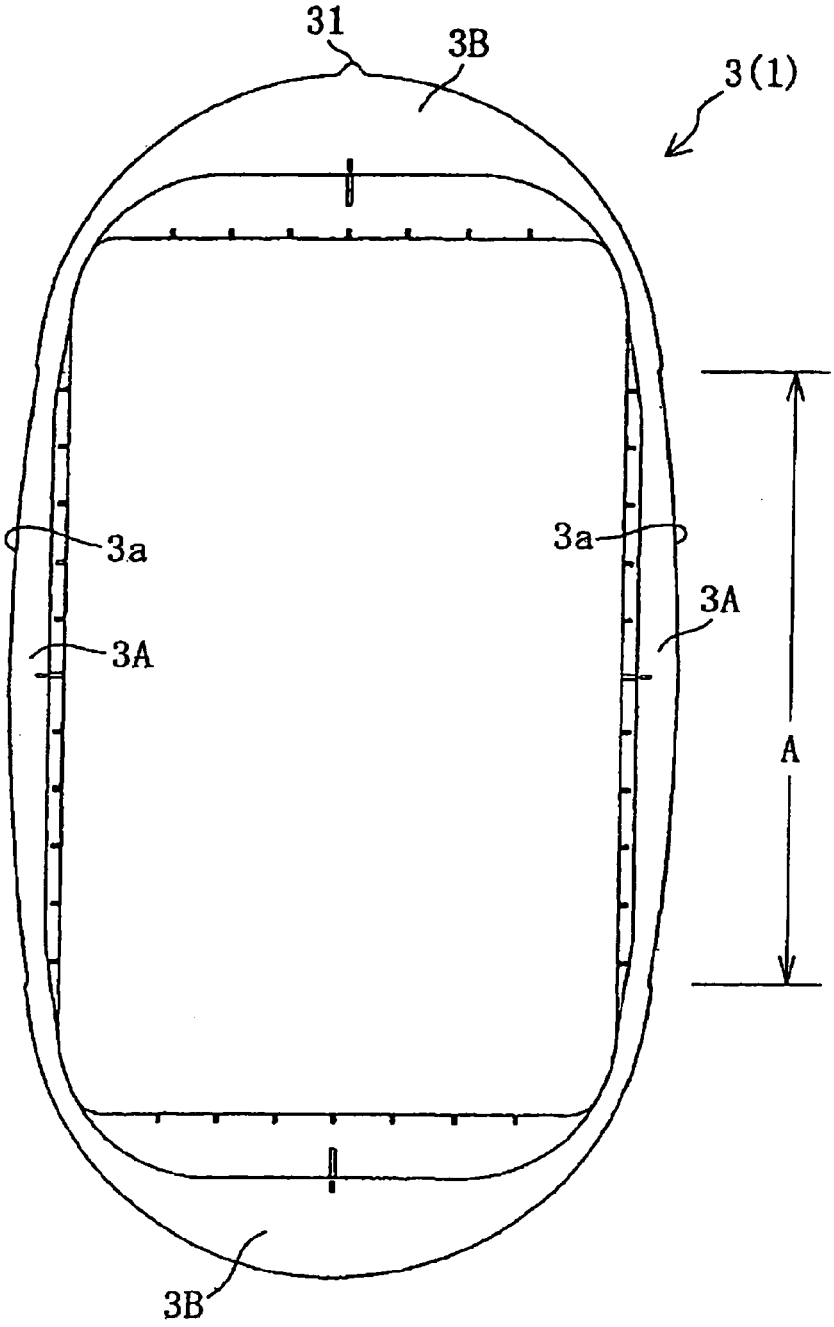
FIG. 3 shows a plan view of an inner frame.

On the other hand, the inner frame 3 is formed by a synthetic resin. As shown in FIG. 3, the inner frame 3 is constructed in an elongated substantially elliptic form having a pair of substantially straight portions 3A corresponding to the substantially straight portions 2A of the outer frame 2 and a pair of circular-arcs 3B corresponding to the circular-arcs 2B of the outer frame 2. Symbol A in FIG. 3 indicates a range of the substantially straight portions 3A of the inner frame 3. That is, the range of the substantially straight portions 2A and the substantially straight portions 3A are the same.

A substantially oblong opening is formed in the inner side of the inner frame 3, and embroidery can be formed on the portion of the workpiece cloth 4 that corresponds to the opening when the workpiece cloth 4 is clamped between the outer and inner frames 2 and 3.

The substantially straight portions 3A of the inner frame 3 are formed so that the widths gradually increase toward the center thereof from the lengthwise ends for securement of rigidity. Also, the circular-arcs 3B of the inner frame 3 are formed so that the widths rapidly increase toward the center from both ends of the circular-arc portion for securement of rigidity.

One of the circular-arc portions 3B corresponding to the circular-arc 2B of the outer frame 2 is formed with a centrally located protrusion 31 functioning as a locating portion to be engaged to the engagement recess 23. The protrusion 31 is formed across the entire vertical direction of the cloth-clamping surface 3*a* of the inner frame 3.

Figure 4:
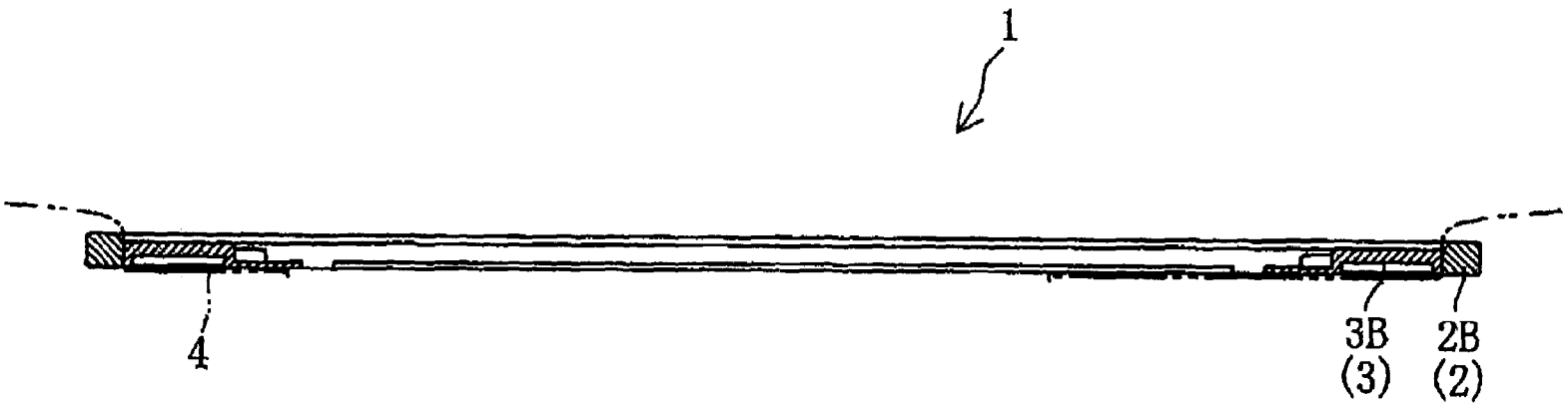
FIG. 4 shows a longitudinal sectional side view of the embroidery frame.
Figure 5:
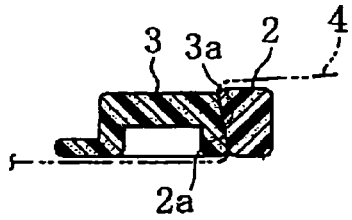
FIG. 5 shows an enlarged sectional view taken along line 5—5 of FIG. 1.
Figure 6:
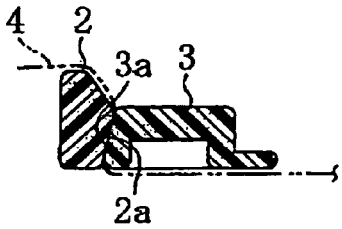
FIG. 6 shows an enlarged sectional view taken along line 6—6 of FIG. 1.

As shown in FIGS. 5 to 8, the cloth-clamping surfaces 2*a* and 3*a* of the substantially straight portions 2A and 3A of the outer frame 2 and the inner frame 3 are constructed as an inclined surface upwardly inclined, for example, 10 to 20 degrees toward the inner side of the embroidery frame 1. That is, the cloth-clamping surfaces 2*a* and 3*a* correspond to the first and the second inclined surface of the present invention respectively. As opposed to this, as shown in FIG. 4, the outer and inner frames 2 and 3 include portions other than the substantially straight portions 2A and 3A, that is, the cloth-clamping surfaces of the circular-arc portions 2B and 3B formed on surfaces perpendicular to the upper or lower surface of the outer and inner frames 2 and 3 respectively.

Therefore, when the workpiece cloth 4 is clamped between the outer and inner frames 2 and 3, the cloth-clamping surface 2*a* of the straight portion 2A of the outer frame 2 contacts the cloth-clamping surface 3*a* of the straight portion 3A of the inner frame 3 from the obliquely upward direction via the workpiece cloth 4. Hence, even if the tension of the workpiece cloth 4 operates, upward-bending deformation of the straight portion 3A of the inner frame 3 is restrained by the outer frame 2, and both the outer frame 2 and the inner frame 3 can be kept in a horizontal state as shown in FIG. 4. Also, upward movement of the inner frame 3 by the tension of the workpiece cloth 4 is also restrained by the outer frame 2.

Furthermore, upon attachment of the inner frame 3 to the outer frame 2, the protrusion 31 is arranged to be engaged to the engagement recess 23 of the outer frame 2. Thus, the inner frame 3 can be attached to the outer frame 2 in a predetermined location. Moreover, since the inner frame 3 is arranged to be received by the inner frame receiving portion 24*a* provided on the outer frame 2, the attachment can be made such that the inner frame 3 has a predetermined relation of vertical location with respect to the outer frame 2.

Figure 11:
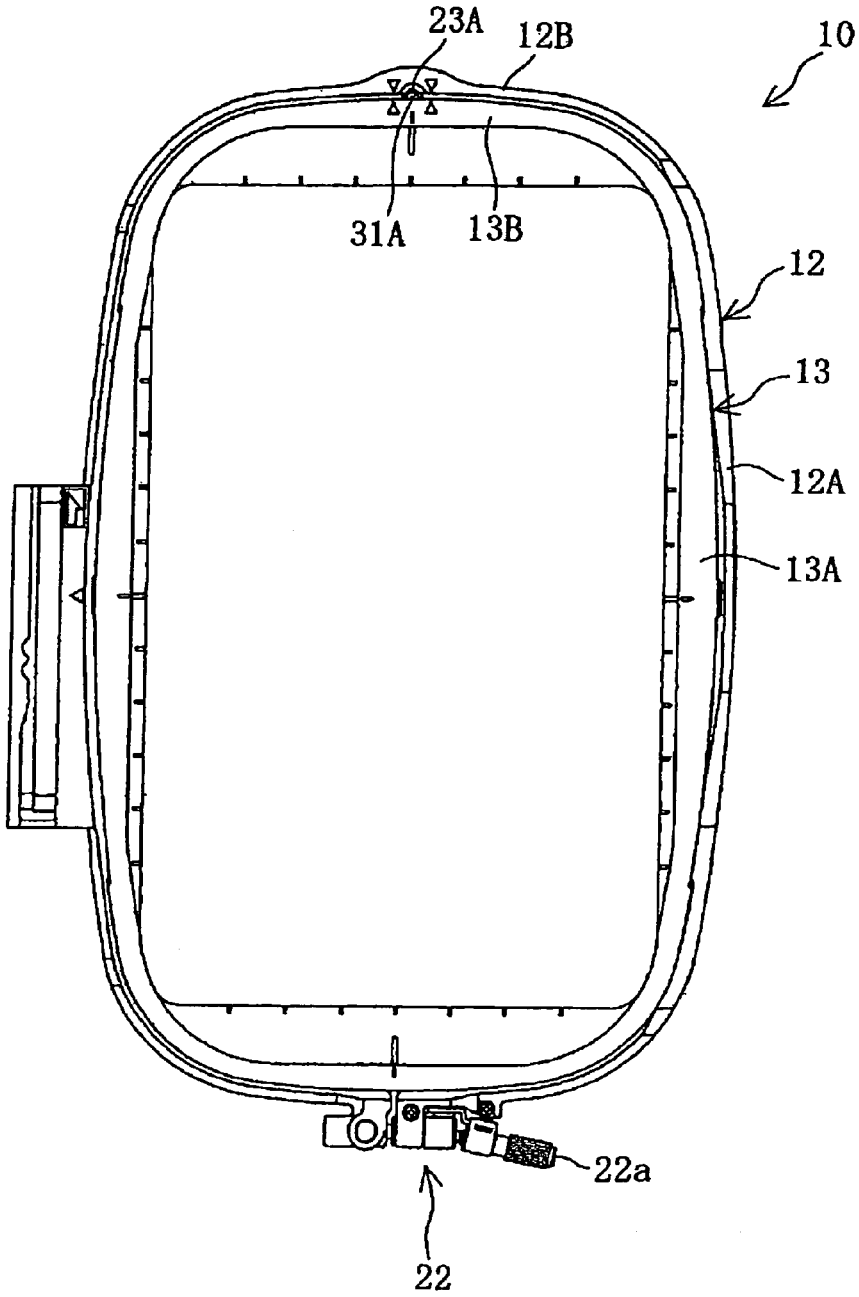
FIG. 11 shows a plan view of an embroidery frame according to a second illustrative aspect of the present disclosure.
Figure 12:
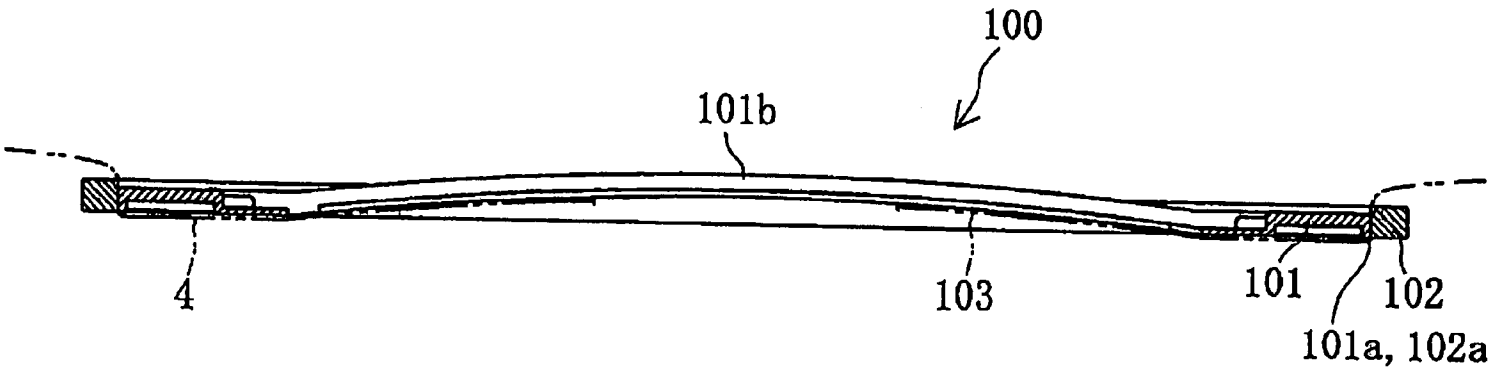
FIG. 12 shows a longitudinal sectional side view of a conventional embroidery frame attached with a workpiece cloth.
Figure 13:
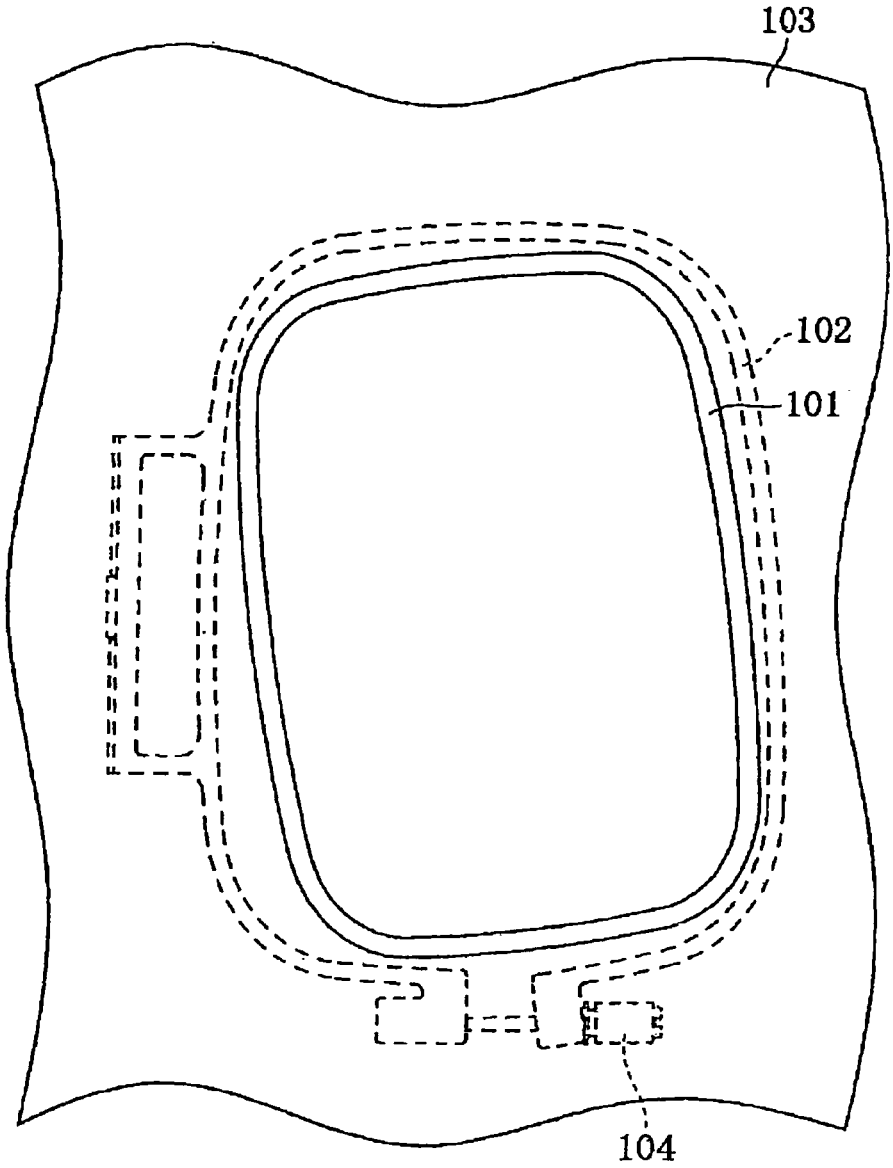
FIG. 13 shows a plan view of a conventional embroidery frame attached with a workpiece cloth.

FIG. 11 indicates a second embodiment of the present invention. Only the difference of the second embodiment from the first embodiment will be described. In the second embodiment, an embroidery frame 10 is formed in a substantially oblong form. That is, the outer and inner frames 12 and 13 of the embroidery frame 10 are provided with a pair of long sides 12A and 13A and a pair of short sides 12B and 13B respectively.

Though, not shown, a whole or a part of the cloth-clamping surface of the long sides 12A and 13A are arranged in an upward inclined surface inclined inward to the embroidery frame 10. Also, an engagement recess 23A is formed in the substantial lengthwise center of the short side 12B of the outer frame 12, and a protrusion 31A is formed in the substantial lengthwise center of the short side 13B. Furthermore, though not shown, a plurality of inner frame receiving portions similar to the inner frame receiving portions 24*a* are formed on the long side 12A of the outer frame 12.

The same operational effect obtained in the first embodiment can be achieved in the above construction as well.

The present invention is not limited to the above described embodiments but can be transformed, for example, as follows.

A plurality of inner frame receiving portions may be provided on the entire range of the inner periphery of the outer frame spaced apart in predetermined intervals.

The present invention is not limited to a substantially elliptic form and a substantially oblong embroidery frame but can also be applied to a circular embroidery frame. In such a case, it is preferable to arrange each of the cloth-clamping surfaces of the outer and inner frames entirely as a inclined surface, however, only a part of the cloth-clamping surface may be arranged as a inclined surface.

The engagement recess functioning as a locating portion can be provided on the inner frame and the protrusion can be provided on the outer frame.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

I claim:

1. An embroidery frame which is detachably attached to an embroidery unit, and which is provided with an outer frame and an inner frame that clamp therebetween an embroidery cloth that extends across an underside of the inner frame, the embroidery frame comprising:

a first inclined surface which is provided at least on a part of a cloth-clamping surface of the outer frame that holds the cloth between the inner and outer frames, and which is upwardly inclined toward an inside of the outer frame; and a second inclined surface which is provided in a portion of the cloth-clamping surface of the inner frame corresponding to the first inclined surface, the inner frame holding the cloth between the outer and inner frames, and which is upwardly inclined toward an inside of the inner frame, wherein:

at least either of the first inclined surface or the second inclined surface has a single incline and a single continuous cloth clamping inclined surface on at least a portion of the outer frame or the inner frame.

2. The embroidery frame according to claim 1, wherein the cloth-clamping surfaces of the outer and inner frames have positioning portions positioning the inner frame relative to the outer frame, respectively, the positioning portions corresponding to each other.

3. The embroidery frame according to claim 2, wherein the positioning portions comprise a vertically extending protrusion provided on the cloth-clamping surface of the inner frame and an engagement recess provided in the cloth-clamping surface of the outer frame, respectively, the protrusion being engaged with the engagement recess.

4. The embroidery frame according to claim 1, wherein the cloth-clamping surface of the outer frame has a lower end near which a plurality of inner frame receiving portions are provided for receiving the inner frame from an underside.

5. The embroidery frame according to claim 1, wherein the outer and inner frames are formed in a substantially elliptic or oval form that has a circular-arc portion and a substantially straight portion, and the first and second inclined surfaces are provided on the cloth-clamping surface of the substantially straight portion of the outer frame and the cloth-clamping surface of the substantially straight portion of the inner frame respectively.

6. The embroidery frame according to claim 5, wherein the circular-arc portions of the outer and inner frames have positioning portions positioning the inner frame relative to the outer frame respectively, the positioning portions being provided near arc central portions of the circular-arc portions of the outer and inner frames respectively.

7. The embroidery frame according to claim 6, wherein the positioning portions comprise a vertically extending protrusion provided on the cloth-clamping surface of the inner frame and an engagement recess provided in the cloth-clamping surface of the outer frame, respectively, the protrusion being engaged with the engagement recess.

8. The embroidery frame according to claim 5, wherein the cloth-clamping surface of the outer frame has a lower end near which a plurality of inner frame receiving portions are provided for receiving the inner frame from an underside.

9. The embroidery frame according to claim 1, wherein the outer and inner frames are each formed in a substantially rectangular form having a long side and a short side, and the first and second inclined surfaces are provided on the cloth-clamping surfaces of the long sides of the outer and inner frames respectively.

10. The embroidery frame according to claim 9, wherein the short sides of the outer and inner frames have positioning portions positioning the inner frame relative to the outer frame respectively, the positioning portions being provided near lengthwise central portions of the short sides of the outer and inner frames respectively.

11. The embroidery frame according to claim 10, wherein the positioning portions comprise a vertically extending protrusion provided on the cloth-clamping surface of the inner frame and an engagement recess provided in the cloth-clamping surface of the outer frame, respectively, the protrusion being engaged with the engagement recess.

12. The embroidery frame according to claim 9, wherein the cloth-clamping surface of the outer frame has a lower end near which a plurality of inner frame receiving portions are provided for receiving the inner frame from an underside.

13. An embroidery frame which is detachably attached to an embroidery unit, and which is provided with an outer frame and an inner frame that clamp embroidery cloth, the embroidery frame comprising:

a first inclined surface which is provided at least on a part of a cloth-clamping surface of the outer frame that holds the cloth between the inner and outer frames, and which is upwardly inclined toward an inside of the outer frame; and a second inclined surface which is provided in a portion of the cloth-clamping surface of the inner frame corresponding to the first inclined surface, the inner frame holding the cloth between the outer and inner frames, and which is upwardly inclined toward an inside of the inner frame, wherein:

the outer and inner frames are formed in a substantially elliptic or oval form that has a circular-arc portion and a substantially straight portion, and the first and second inclined surfaces are provided on the cloth-clamping surface of the substantially straight portion of the outer frame and the cloth-clamping surface of the substantially straight portion of the inner frame respectively, and the circular-arc portions of the outer and inner frames have positioning portions positioning the inner frame relative to the outer frame respectively, the positioning portions being provided near arc central portions of the circular-arc portions of the outer and inner frames respectively.

14. The embroidery frame according to claim 13, wherein the positioning portions comprise a vertically extending protrusion provided on the cloth-clamping surface of the inner frame and an engagement recess provided in the cloth-clamping surface of the outer frame, respectively, the protrusion being engaged with the engagement recess.

* * * * *